US010338494B2

(12) United States Patent
Takaya et al.

(10) Patent No.: US 10,338,494 B2
(45) **Date of Patent: *Jul. 2, 2019**

(54) DEVELOPING APPARATUS AND IMAGE FORMING APPARATUS HAVING DEVELOPER MOVEMENT APPARATUS

(71) Applicant: KONICA MINOLTA, INC., Chiyoda-ku, Tokyo (JP)

(72) Inventors: Shunichi Takaya, Tokyo (JP); Hideaki Tanaka, Tokyo (JP); Kazuteru Ishizuka, Saitama (JP); Shota Sakurai, Tokyo (JP); Kei Okamura, Yokohama (JP); Kei Yuasa, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/695,265

(22) Filed: Sep. 5, 2017

(65) Prior Publication Data

US 2018/0067418 A1 Mar. 8, 2018

(30) Foreign Application Priority Data

Sep. 5, 2016 (JP) ..... 2016-172590

(51) Int. Cl.
*G03G 15/08* (2006.01)

(52) U.S. Cl.
CPC ..... *G03G 15/0808* (2013.01); *G03G 15/0887* (2013.01); *G03G 15/0889* (2013.01);
(Continued)

(58) Field of Classification Search
CPC ..... G03G 15/0808; G03G 15/0887; G03G 15/0889; G03G 2215/0658; G03G 15/0848; G03G 15/0849; G03G 15/0856; G03G 15/0877; G03G 15/0893; G03G 15/5041; G03G 15/5058
See application file for complete search history.

(56) References Cited

U.S. PATENT DOCUMENTS 7,471,920 B2 * 12/2008 Akedo ..... G03G 15/0893 399/254
2007/0140744 A1 * 6/2007 Akedo ..... G03G 15/0893 399/254

(Continued)

FOREIGN PATENT DOCUMENTS

JP 2007163990 A 6/2007
JP 2009175635 A 8/2009
JP 2017078758 A * 4/2017

*Primary Examiner* — David M. Gray
*Assistant Examiner* — Laura Roth
(74) *Attorney, Agent, or Firm* — Cantor Colburn LLP

(57) ABSTRACT

A developing apparatus includes a developer carrier that carries a developer, and a developer casing that contains the developer to be supplied to the developer carrier. An opening/closing part is capable of controlling a moving amount of the developer between a first region on one side in an axial direction of the developer carrier and a second region on the other side in the axial direction of the developer carrier by opening or closing the first region and the second region. A hardware processor controls an open/closed state of the opening/closing part in accordance with the state of the developer in the first region and the second region.

12 Claims, 9 Drawing Sheets

(52) U.S. Cl.
CPC ..... *G03G 15/0893* (2013.01); *G03G 15/0849* (2013.01); *G03G 2215/0658* (2013.01)

(56) References Cited

U.S. PATENT DOCUMENTS

| | | | | |
|---|---|---|---|---|
| 2007/0166079 | A1* | 7/2007 | Ichikawa | G03G 21/105 399/254 |
| 2010/0104305 | A1* | 4/2010 | Morimoto | G03G 15/0849 399/58 |
| 2010/0322670 | A1* | 12/2010 | Ishiguro | G03G 15/0853 399/254 |
| 2018/0059578 | A1* | 3/2018 | Sakurai | G03G 15/0889 |
| 2018/0107137 | A1* | 4/2018 | Okamura | G03G 15/105 |

* cited by examiner

DEVELOPING APPARATUS AND IMAGE FORMING APPARATUS HAVING DEVELOPER MOVEMENT APPARATUS

CROSS-REFERENCE TO RELATED APPLICATIONS

The present application claims priority under 35 U.S.C. § 119 to Japanese Patent Application No. 2016-172590, filed on Sep. 5, 2016, the entire content of which are incorporated herein by reference.

BACKGROUND

Technological Field

The present invention relates to a developing apparatus and an image forming apparatus.

Description of the Related Art

Generally, an image forming apparatus (printer, copier, facsimile, etc.) utilizing an electrophotographic process technology forms an electrostatic latent image based on image data by emitting laser light (exposure) toward a charged photoconductive drum (image carrier). The image forming apparatus forms a toner image by visualizing the electrostatic latent image by supplying toner from a developing apparatus to the photoconductive drum on which the electrostatic latent image is formed. The toner image is then directly or indirectly transferred to a sheet, and thereafter, the toner image is formed on the sheet by heating, pressurizing and fixing at a fixing nip.

The developing apparatus includes a stirring member for stirring a developer in the developing apparatus. There in a known configuration of the stirring member in which the developer is stirred such that the developer moves in an axial direction of the developing sleeve. In such a configuration, for example, in a case where the size of the developing apparatus is increased in order to cope with a long sheet in the axial direction such as B1 size, the toner is mixed from an upstream side in a moving direction of the developer, and this causes a problem of tendency to increase deviation of toner concentration in the axial direction.

In order to cope with this problem, for example, JP 50-27333 A discloses a configuration of circulating the developer in each of regions on one side and the other half side in the axial direction inside the developing apparatus. FIG. 1 is a simplified diagram illustrating a developing apparatus in a conventional example.

As illustrated in FIG. 1, a developing apparatus 412 includes a developing sleeve 412A and a developer casing 412B. The developer casing 412B includes a first stirring member 412C and a second stirring member 412D that stir the developer in the developer casing 412B.

Each of the first stirring member 412C and the second stirring member 412D has a configuration in which the direction of wings are opposite to each other between a first region B1 on one side and a second region B2 on the other side with respect to a central portion in the axial direction of the developing sleeve 412A. Together with the rotation of the first stirring member 412C and the second stirring member 412D, the developer circulates in the first region B1 and the second region B2 along the flow of arrows B10 and B20, respectively.

In addition, JP 3-260678 A discloses a configuration capable of suppressing an occurrence of a difference in toner concentration between the first region B1 and the second region B2 by actively running the developer in both of the first region B1 and the second region B2 on the boundary between the first region B1 and the second region B2.

A configuration disclosed in JP 50-27333 A, however, might cause a problem that, in the case of continuously forming an image in which a portion corresponding to either one of the first region B1 and the second region B2 includes a toner amount extremely larger than the portion corresponding to the other region, solely the toner concentration in the portion corresponding to the one extremely decreases.

In addition, in the configuration described in JP 3-260678 A, in a case where the image is continuously formed, the toner concentration of either one of the first region B1 and the second region B2 extremely decreases, and thus, the other toner concentration decreases due to the decrease in the one. This decreases the toner concentration in the whole developing apparatus from the beginning of image forming processing for the above-described image, leading to an increased time to recover the toner concentration in the whole developing apparatus.

Moreover, in a case where the first region B1 and the second region B2 are divided by partitions, the amount of carrier consumption at a charging failure and the amount of developer deterioration generated at continuous formation of an image of low coverage differ between the first region B1 and the second region B2. This leads to difficult in uniformizing the state of the developer (deviation of the developer amount and the deterioration amount of the developer) in the first region B1 and the second region B2 in the whole axial direction of the developing apparatus.

SUMMARY

An object of the present invention is to provide a developing apparatus and an image forming apparatus.

To achieve the abovementioned object, according to an aspect of the present invention, a developing apparatus reflecting one aspect of the present invention comprises:

a developer carrier that carries a developer;

a developer casing that contains the developer to be supplied to the developer carrier;

an opening/closing part capable of controlling a moving amount of the developer between a first region on one side in an axial direction of the developer carrier and a second region on the other side in the axial direction of the developer carrier by opening or closing the first region and the second region; and a hardware processor that controls an open/closed state of the opening/closing part in accordance with the state of the developer in the first region and the second region.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
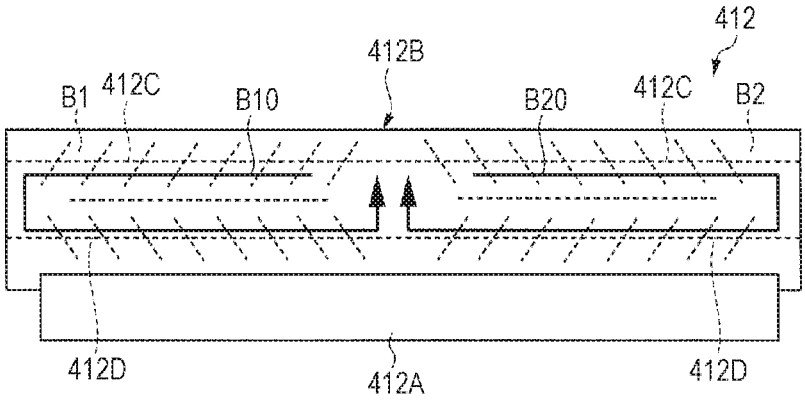
FIG. 1 is a simplified diagram illustrating a developing apparatus in a conventional example.
Figure 2:
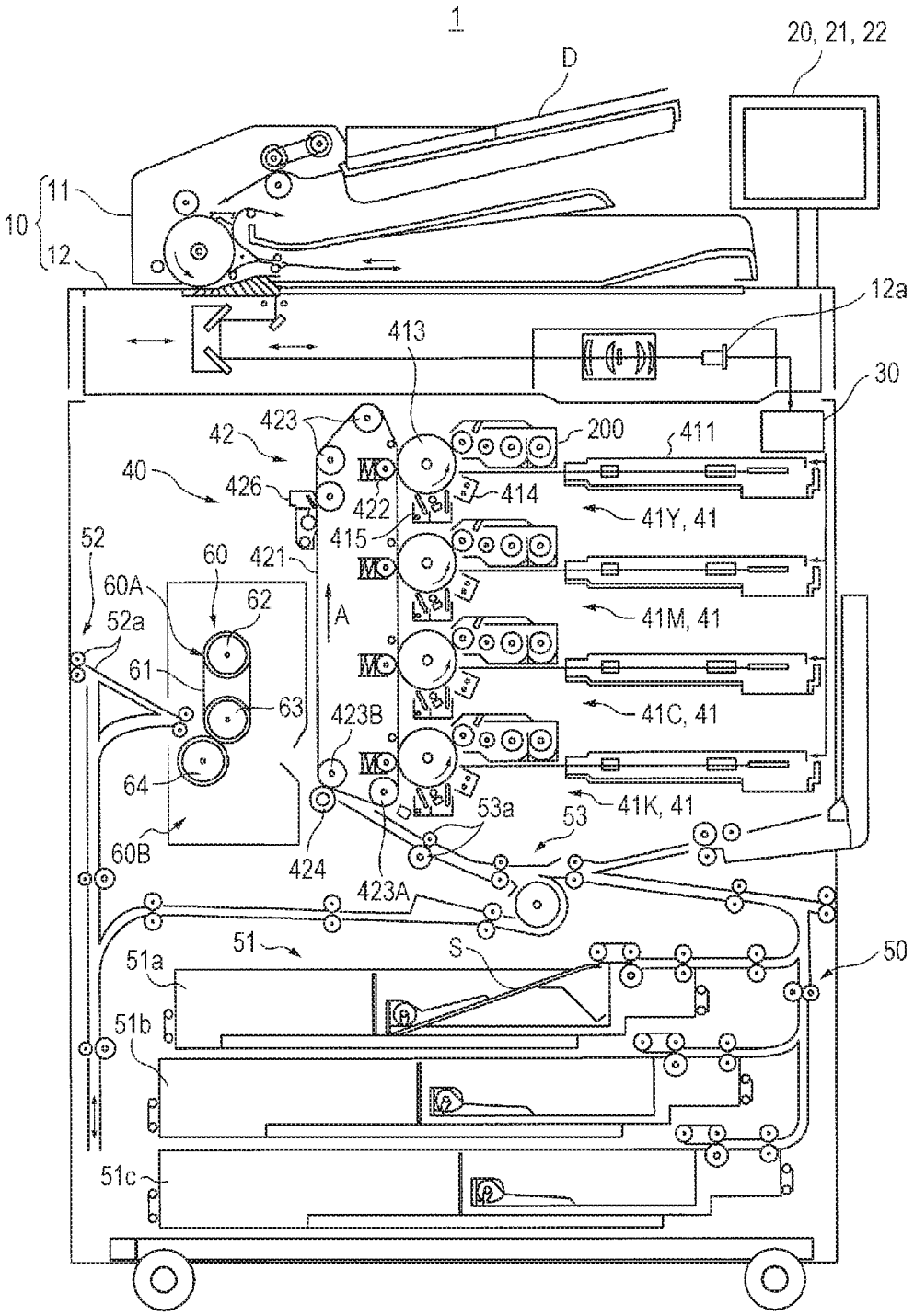
FIG. 2 is a diagram schematically illustrating a whole configuration of an image forming apparatus according to the present embodiment.
Figure 3:
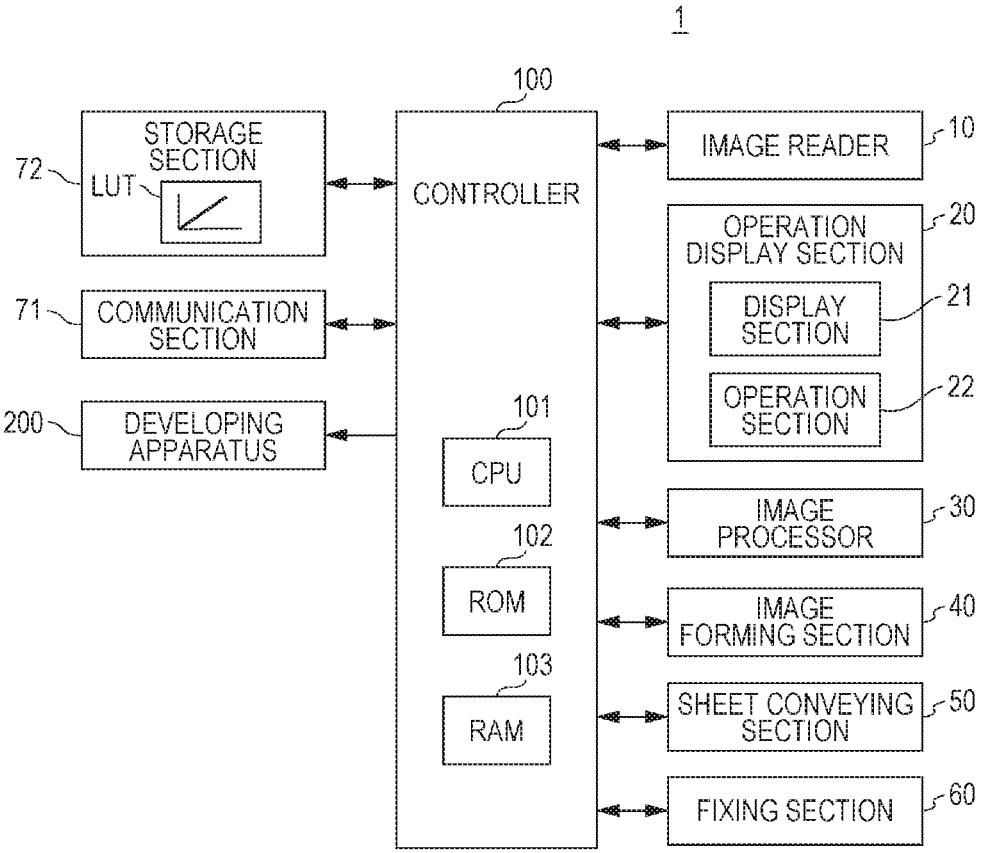
FIG. 3 is a diagram illustrating a main portion of a control system of the image forming apparatus according to the present embodiment.

Hereinafter, one or more embodiments of the present invention will be described in detail with reference to the drawings. However, the scope of the invention is not limited to the disclosed embodiments. FIG. 2 is a diagram schematically illustrating a whole configuration of an image forming apparatus 1 according to the present embodiment. FIG. 3 is a diagram illustrating a main portion of a control system of the image forming apparatus 1 according to the present embodiment.

The image forming apparatus 1 illustrated in FIGS. 2 and 3 is an intermediate transfer system color image forming apparatus utilizing an electrophotographic process technology. Specifically, the image forming apparatus 1 performs primary transfer of toner images of each of colors of yellow (Y), magenta (M), cyan (C), and black (K) formed on a photoconductive drum 413 to an intermediate transfer belt 421, and then, the toner images of the four colors are overlapped with each other on the intermediate transfer belt 421, and then, the toner image secondary-transferred onto a sheet S, thereby forming an image.

The image forming apparatus 1 adopts a tandem system in which the photoconductive drums 413 corresponding to the four colors of Y, M, C, and K are arranged in series in a running direction of the intermediate transfer belt 421, and the toner images of individual colors are sequentially transferred onto the intermediate transfer belt 421 in a single procedure.

The image forming apparatus 1 includes an image reader 10, an operation display section 20, an image processor 30, an image forming section 40, a sheet conveying section 50, a fixing section 60, and a controller 100.

The controller 100 includes a central processing unit (CPU) 101, a read only memory (ROM) 102, and a random access memory (RAM) 103. The CPU 101 reads a program corresponding to processing content from the ROM 102, develops the program in the RAM 103, and centrally controls operation of each of blocks of the image forming apparatus 1 in cooperation with the developed program. At this time, various types of data stored in the storage section 72 is referenced. The storage section 72 includes, for example, a nonvolatile semiconductor memory (or flash memory) and a hard disk drive.

The controller 100 transmits/receives various types of data to/from an external apparatus (for example, a personal computer) connected to a communication network such as a local area network (LAN), a wide area network (WAN) via a communication section 71. For example, the controller 100 receives image data (input image data) transmitted from an external apparatus and allows an image to be formed on the sheet S on the basis of the image data. The communication section 71 includes a communication control card such as a LAN card.

The image reader 10 includes an automatic document feeder (ADF) 11, and a document image scanner (scanner) 12.

The automatic document feeder 11 conveys a document D placed in a document tray by a conveyance mechanism and feeds the document to the document image scanner 12. With the automatic document feeder 11, it is possible to collectively read images (including double-sided image) on a large number of the documents D placed in the document tray.

The document image scanner 12 optically scans a document conveyed onto a contact glass portion from the automatic document feeder 11 or a document placed on the contact glass portion, and reads a document image by focusing reflected light from the document to form an image on a light receiving plane of a charge coupled device (CCD) sensor 12*a*. The image reader 10 generates input image data on the basis of a reading result by the document image scanner 12. The input image data undergoes predetermined image processing in the image processor 30.

The operation display section 20 includes a liquid crystal display (LCD) having a touch panel, for example, and functions as a display section 21 and an operation section 22. According to a display control signal input from the controller 100, the display section 21 displays various operation screens, image condition, individual function operation status, internal information of the image forming apparatus 1, or the like. The operation section 22 includes various operation keys such as a numeric keypad, and a start key, receives various input operation from a user, and outputs an operation signal to the controller 100.

The image processor 30 includes a circuit, or the like, for performing digital image processing corresponding to initial setting or user setting, on the input image data. For example, the image processor 30 performs tone correction on the basis of tone correction data (tone correction table) under the control of the controller 100. In addition to the tone correction, the image processor 30 applies various types of correction processing such as color correction, shading correction, compression processing, on the input image data. The image forming section 40 is controlled on the basis of the processed image data.

The image forming section 40 includes image forming units 41Y, 41M, 41C, and 41K for forming images with color toners of a Y component, a M component, a C component, and a K component, on the basis of the input image data, and includes an intermediate transfer unit 42.

The image forming units 41Y, 41M, 41C, and 41K for the Y component, the M component, the C component, and the K component have a similar configuration. For the convenience of illustration and explanation, components common with each other are denoted by the same reference sign, and Y, M, C, or K is added to the reference sign when there is a need to distinguish between them. In FIG. 2, reference signs are provided solely to the components of the image forming unit 41Y for the Y component and the reference signs of the components of the other image forming units 41M, 41C, 41K are omitted.

The image forming unit 41 includes an exposure apparatus 411, a developing apparatus 200, a photoconductive drum 413, a charging apparatus 414, and a drum cleaning apparatus 415.

The photoconductive drum 413 is a negative charge type organic photoconductor (OPC) formed, for example, with an under coat layer (UCL), a charge generation layer (CGL), a charge transport layer (CTL), sequentially laminated on a peripheral surface of an aluminum conductive cylindrical body (aluminum pipe).

The charging apparatus 414 uniformly charges the surface of the photoconductive drum 413 having photoconductivity to negative polarity by generating corona discharge.

The exposure apparatus 411 includes, for example, a semiconductor laser, and emits laser light corresponding to images of individual color components toward the photoconductive drum 413. A positive charge is generated in the charge generation layer of the photoconductive drum 413 and transported to the surface of the charge transport layer, whereby the surface charge (negative charge) of the photoconductive drum 413 is neutralized. An electrostatic latent image of each of the color components is formed on the surface of the photoconductive drum 413 due to a potential difference with the surroundings.

The developing apparatus 200 is a two-component reversal type developing apparatus and forms a toner image by visualizing the electrostatic latent image by adhering toner of each of the color components to the surface of the photoconductive drum 413. The developing apparatus 200 forms the toner image on the surface of the photoconductive drum 413 by supplying the toner contained in the developer to the photoconductive drum 413.

The drum cleaning apparatus 415 includes a drum cleaning blade that comes in sliding contact with the surface of the photoconductive drum 413, and removes transfer residual toner remaining on the surface of the photoconductive drum 413 after primary transfer.

The intermediate transfer unit 42 includes an intermediate transfer belt 421, a primary transfer roller 422, a plurality of support rollers 423, a secondary transfer roller 424, and a belt cleaning apparatus 426.

The intermediate transfer belt 421 is formed of an endless belt and stretched in a loop around a plurality of support rollers 423. At least one of the plurality of support rollers 423 is constituted with a driving roller, and the other is (are) constituted by a driven roller. The rotation of the driving roller allows the intermediate transfer belt 421 to run in a direction A at a constant speed. The intermediate transfer belt 421 is a belt having conductivity and elasticity, and is rotationally driven by a control signal from the controller 100.

The primary transfer roller 422 is arranged on an inner peripheral surface side of the intermediate transfer belt 421 so as to face the photoconductive drum 413 of each of the color components. The primary transfer roller 422 comes in pressing contact with the photoconductive drum 413 having the intermediate transfer belt 421 in between, thereby forming a primary transfer nip for transferring a toner image from the photoconductive drum 413 to the intermediate transfer belt 421.

The secondary transfer roller 424 is arranged on the outer peripheral surface side of the intermediate transfer belt 421 so as to face a backup roller 423B arranged on a downstream side in a belt running direction of the driving roller 423A. The secondary transfer roller 424 comes in pressing contact with the backup roller 423B having the intermediate transfer belt 421 in between, thereby forming a secondary transfer nip for transferring a toner image from the intermediate transfer belt 421 to the sheet S.

The belt cleaning apparatus 426 removes the transfer residual toner remaining on the surface of the intermediate transfer belt 421 after the secondary transfer.

When the intermediate transfer belt 421 passes through the primary transfer nip, the toner images on the photoconductive drum 413 are overlapped and primary-transferred sequentially onto the intermediate transfer belt 421. Specifically, a primary transfer bias is applied to the primary transfer roller 422, and a charge having a polarity opposite to the polarity of the toner is applied to the back side of the intermediate transfer belt 421, that is, the side coming in contact with the primary transfer roller 422, whereby the toner image is electrostatically transferred to the intermediate transfer belt 421.

Thereafter, when the sheet S passes through the secondary transfer nip, the toner image on the intermediate transfer belt 421 is secondary-transferred onto the sheet S. Specifically, a secondary transfer bias is applied to the backup roller 423B and a charge with the same polarity as the toner is provided to the front side of the sheet S, that is, the side that abuts the intermediate transfer belt 421, whereby the toner image is electrostatically transferred to the sheet S.

The fixing section 60 includes an upper fixing section 60A and a lower fixing section 60B. The upper fixing section 60A includes a fixing surface-side member arranged on a toner image formation-side surface of the sheet S, that is, a fixing surface of the sheet S. The lower fixing section 60B includes back side support member arranged on a side opposite to the fixing surface, that is, a back side of the sheet S. The back side support member comes in pressing contact with the fixing surface-side member, whereby a fixing nip for holding and conveying the sheet S is formed.

The fixing section 60 is configured to heat and pressurize, at the fixing nip, the conveyed sheet S on which the toner image is secondary-transferred, thereby fixing the toner image on the sheet S.

The upper fixing section 60A includes an endless fixing belt 61, a heating roller 62, and a fixing roller 63 which are fixing surface-side members. The fixing belt 61 is stretched by the heating roller 62 and the fixing roller 63.

The lower fixing section 60B includes a pressure roller 64 as the back side support member. The pressure roller 64 forms a fixing nip for conveying the sheet S by holding the sheet B between oneself and the fixing belt 61.

The sheet conveying section 50 includes a sheet feeding section 51, a sheet discharge section 52, a conveying path section 53. In the three sheet feeding tray units 51*a* to 51*c* constituting the sheet feeding section 51, the sheet S (standard sheets and special sheets) identified on the basis of the grammage and size of the sheet S is contained being classified into each of preset types.

The conveying path section 53 has a plurality of conveying roller pairs such as a pair of registration rollers 53*a*. The sheets S contained in the sheet feeding tray units 51*a* to 51*c* are fed one by one from the uppermost portion and are conveyed to the image forming section 40 by the conveying path section 53. At this time, a registration roller section including a pair of registration rollers 53*a* corrects inclination of the fed sheet S and adjusts a conveyance timing. Subsequently, the toner image of the intermediate transfer belt 421 is collectively secondary-transferred onto one surface of the sheet S on the image forming section 40, and then, undergoes a fixing process on the fixing section 60. The sheet S on which an image has been formed is discharged to the outside of the apparatus by the sheet discharge section 52 having a sheet discharging roller 52*a*.

Figure 4:
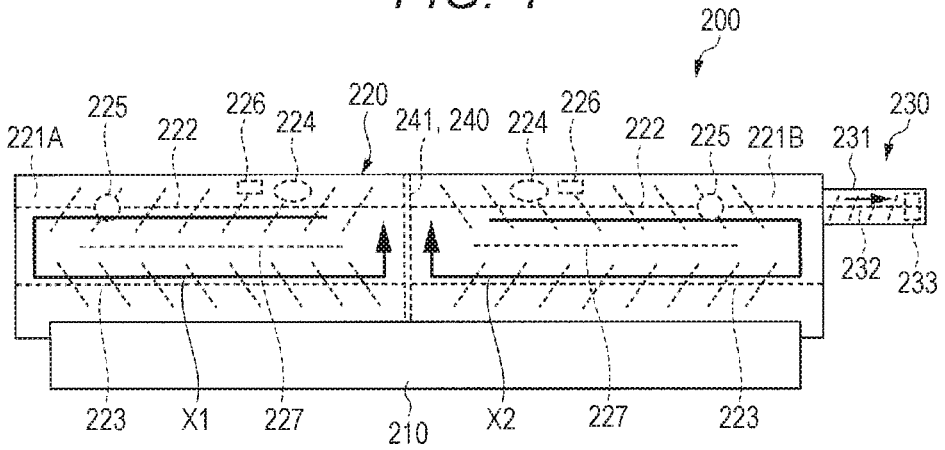
FIG. 4 is a top view of the developing apparatus when an opening/closing part is in a closed state.
Figure 5:
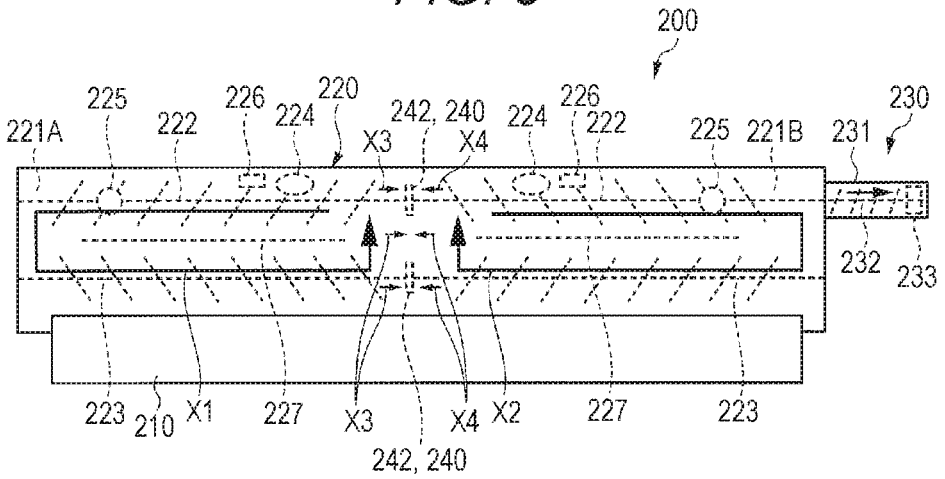
FIG. 5 is a top view of the developing apparatus when the opening/closing part is in an open state.

Next, details of the developing apparatus 200 will be described. FIG. 4 is a top view of the developing apparatus 200 when an opening/closing part 240 is in a closed state. FIG. 5 is a top view of the developing apparatus 200 when the opening/closing part 240 is in an open state.

As illustrated in FIGS. 4 and 5, the developing apparatus 200 has a size that can handle a long sheet in the axial direction such as B1 size, and includes a developing sleeve 210, a developer casing 220, and a developer discharging section 230. The developing sleeve 210 is a developer carrier that carries the developer, and has a length corresponding to the sheet having a long length in the axial direction. Note that the diameter of the developing sleeve 210 in the present embodiment is set to 25 mm.

The developer casing 220 contains the developer to be supplied to the developing sleeve 210. The developer casing 220 includes the opening/closing part 240 located between a first region 221A and a second region 221B. The first region 221A is a region on one side with respect to a portion corresponding to the central portion in the axial direction of the developing sleeve 210. The second region 221B is a region on the other side with respect to the portion corresponding to the central portion in the axial direction of the developing sleeve 210. The opening/closing part 240 will be described below.

In the present embodiment, the amount of developer that can be contained in the developer casing 220 is 1200 g.

Each of the first region 221A and the second region 221B of the developer casing 220 includes a first stirring member 222, a second stirring member 223, a toner concentration detector 224, a toner supplier 225, and a liquid level detector 226. The first stirring member 222 and the second stirring member 223 of the first region 221A correspond to a "first stirrer" of the present invention. The first stirring member 222 and the second stirring member 223 of the second region 221B correspond to a "second stirrer" of the present invention.

The first stirring member 222 is provided in a portion farther from the developing sleeve 210 compared with the second stirring member 223, in each of the first region 221A and the second region 221B. In the first region 221A and the second region 221B, the first stirring member 222 moves the developer from a portion corresponding to the central portion in the axial direction of the developing sleeve 210 to a portion corresponding to an end portion The second stirring member 223 is provided in a portion of the first region 221A and the second region 221B, facing the developing sleeve 210. The second stirring member 223 moves the developer from the portion corresponding to the end portion in the axial direction of the developing sleeve 210 to the portion corresponding to the central portion, in the first region 221A and the second region 221B.

The first stirring member 222 and the second stirring member 223 in the present embodiment are configured to set a diameter to 25 mm and a rotation speed to 450 rpm.

In each of the first region 221A and the second region 221B, the region of the first stirring member 222 and the region of the second stirring member 223 are divided by a partition plate 227. The region of the first stirring member 222 and the region of the second stirring member 223 in the first region 221A and the second region 221B are divided by the partition plate 227, and thus are connected with each other at a portion corresponding to the end portions of the first stirring member 222 and the second stirring member 223. Accordingly, the rotation of the first stirring member 222 and the second stirring member 223 allows the developer to move in the directions of arrows X1 and X2 in the first region 221A and the second region 221B, and eventually the developer in the first region 221A and the second region 221B are stirred.

The toner concentration detector 224 detects the concentration of the toner in the first region 221A and the second region 221B. The toner supplier 225 supplies toner to each of the first region 221A and the second region 221B. The controller 100 controls the toner supply amount in the toner supplier 225 on the basis of a result of detection by the toner concentration detector 224.

The liquid level detector 226 is an ON/OFF sensor, for example, and detects the liquid level of the developer in the developer casing 220. For example, the liquid level detector 226 outputs ON when the liquid level of the developer becomes high within a detection range of the liquid level detector 226. Moreover, the liquid level detector 226 outputs OFF when the liquid level of the developer becomes lower than the detection range of the liquid level detector 226.

The liquid level of the developer is relatively high in a case where the chargeability of the toner is larger than a target charge amount (for example, 40 μC/g), and is relatively low when the chargeability of the toner is lower than the target charge amount. This is because when the chargeability of the toner is good, the toners repel each other, leading to a high liquid level of the developer, and when the chargeability of the toner is poor, the toners do not repel each other, leading to a low liquid level of the developer.

The developer discharging section 230 is a portion that discharges the developer in the developer casing 220 and is provided in a portion corresponding to the second region 221B in the developer casing 220. The developer discharging section 230 includes a passage section 231, a screw member 232, and a discharge section 233.

The passage section 231 is a portion that communicates with the developer casing 220 and the discharge section 233. The screw member 232 is arranged in the passage section 231 and is coaxial with the first stirring member 222. Rotation of the screw member 232 generates a flow to move the developer from the passage section 231 toward the inside of the developer casing 220. The screw member 232 holds the developer in the developer casing 220 from entering the passage section 231.

In a case where the carrier among the developer in the developer casing 220 deteriorates, for example, carrier is supplied to the inside of the developer casing 220 from a carrier supplier (not illustrated), and when the developer that can be contained in the developer casing 220 is exceeded, the developer moves from the developer casing 220 to the passage section 231 and is discharged from the discharge section 233.

Figure 6A:
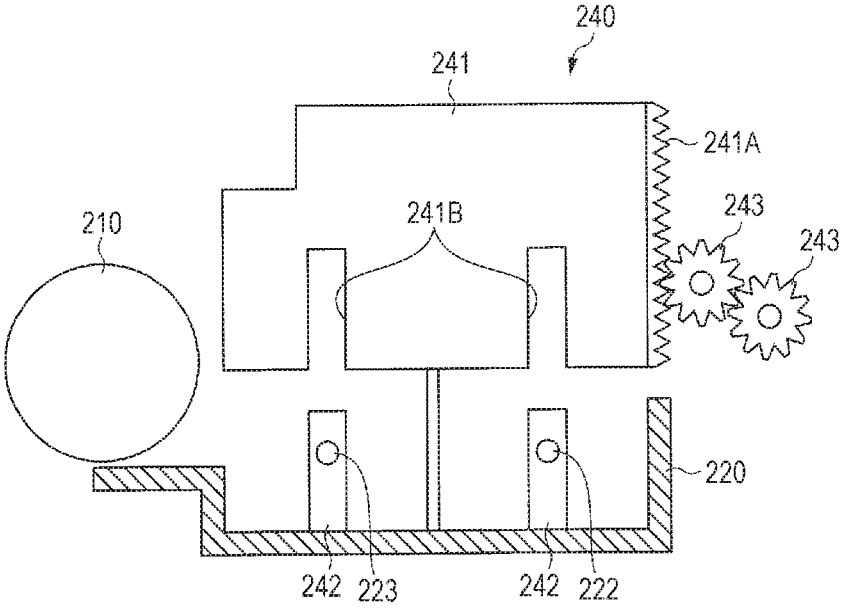
FIG. 6A is a diagram illustrating a state in which the opening/closing part is in the open state.
Figure 6B:
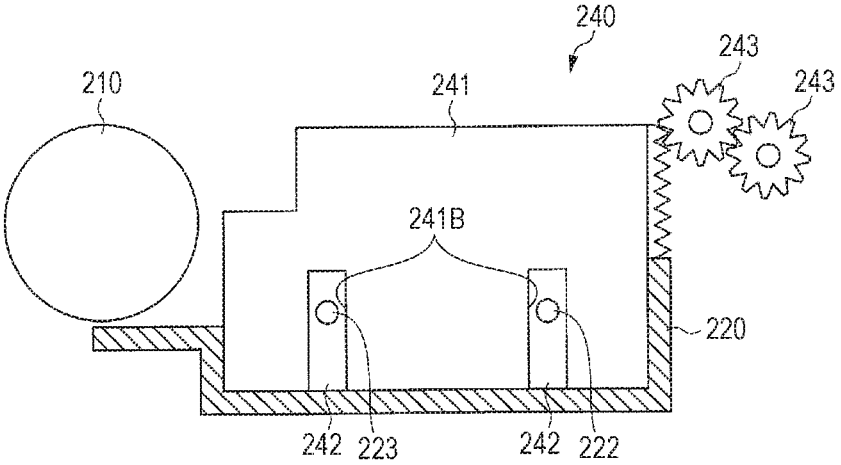
FIG. 6B is a diagram illustrating a state in which the opening/closing part is in the closed state.

Next, the opening/closing part 240 will be described. FIG. 6A is a diagram illustrating a state in which the opening/closing part 240 is in the open state. FIG. 6B is a diagram illustrating a state in which the opening/closing part 240 is in a closed state.

The opening/closing part 240 is configured to be able to open and close the first region 221A and the second region 221B. Specifically, the opening/closing part 240 can control the moving amount of the developer by opening and closing the first region 221A and the second region 221B. The opening/closing part 240 includes a moving member 241 and a bearing member 242.

The moving member 241 is formed of a plate-like member, and is configured to have a width that can close the first region 221A and the second region 221B. The moving member 241 is formed with a gear tooth section 241A that meshes with a portion of a transmission gear 243 to which an external drive is transmitted. The rotation of the transmission gear 243 moves the moving member 241 up and down. The moving member 241 is located at the uppermost side in an open state position (refer to FIG. 6A) and at the lowermost side in the closed state (refer to FIG. 6B).

The bearing member 242 is a portion that receives shafts of the first stirring member 222 and the second stirring member 223 and protrudes from a position that corresponds to each of the first stirring member 222 and the second stirring member 223, on a lower wall of the developer casing 220.

An engaging portion 241B engageable with the bearing member 242 is formed at the lower end portion of the moving member 241. The bearing member 242 is engaged with the engaging portion 241B of the moving member 241, whereby the first region 221A and the second region 221B are closed in the closed state. When the opening/closing part 240 is in the closed state, the moving amount of the developer between the first region 221A and the second region 221B is zero.

Moreover, the first region 221A and the second region 221B are opened when the moving member 241 is in the open state. Accordingly, the developer can pass through the portion without the bearing member 242 to move between the first region 221A and the second region 221B in the direction of arrows X3 and X4 in FIG. 5.

While the position of the moving member 241 is higher in the open state than in the closed state, it is allowable to configure such that the position is lower than the position in the closed state. Moreover, the moving member 241 may be configured to move solely inside the developer casing 220, or the position in the open state may be a position outside the developer casing 220.

Figure 7:
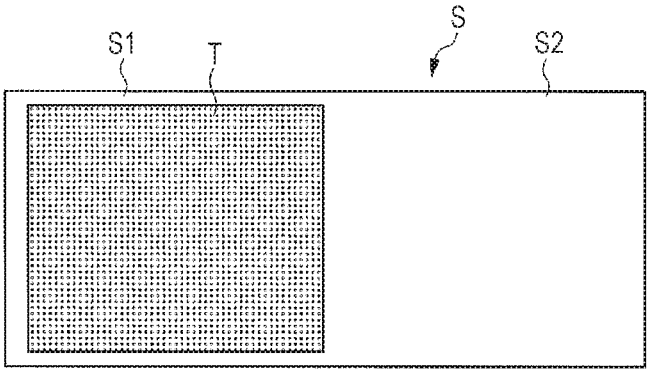
FIG. 7 is a diagram illustrating a sheet including a toner image having a large coverage difference between a portion corresponding to a first region and a portion corresponding to a second region.

Incidentally, in the configuration in which the first region 221A and the second region 221B are not closed, for example, in a case where a toner image T in which the amount of toner of a portion S1 corresponding to the first region 221A is extremely larger than the amount of toner of a portion S2 corresponding to the second region 221B is continuously formed as illustrated in FIG. 7, there arises a problem that the toner concentration in the portion corresponding to the first region 221A decreases.

Figure 8:
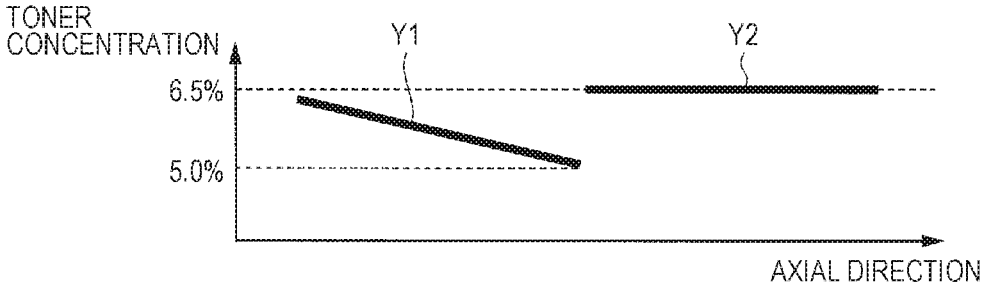
FIG. 8 is a diagram illustrating the toner concentration in the axial direction inside a developer casing.

Specifically, when the toner image T illustrated in FIG. 7 is continuously formed, solely the toner consumption amount in the first region 221A is extremely increased. Accordingly, as illustrated in FIG. 8, the toner concentration in the first region 221A decreases at a position more distant from the toner supplier 225 in the axial direction, that is, decreases at a position more toward the center from the left end portion in the axial direction (refer to solid line Y1). In contrast, the toner concentration in the second region 221B remains substantially the same as a target concentration (for example, 6.5%) (refer to solid line Y2).

In a case where the first region 221A and the second region 221B are opened in this manner, performing image formation with the toner amount being concentrated on one side half in the axial direction would increase the deviation of the toner concentration in the axial direction.

To cope with this, in the present embodiment, the controller 100 determines whether to switch the opening/closing part 240 from the open state to the closed state in accordance with a difference between the toner concentration in the first region 221A and the toner concentration in the second region 221B, detected by the toner concentration detector 224 when the opening/closing part 240 is in the open state.

Specifically, the controller 100 switches the opening/closing part 240 from the open state to the closed state when the difference between the toner concentration in the first region 221A and the toner concentration in the second region 221B is larger than a first threshold (for example, 0.5%). In a case where the opening/closing part 240 is switched from the open state to the closed state, the controller 100 controls the toner supplier 225 so as to increase the toner supply amount for the region with the larger toner consumption amount, that is, the region with lower toner concentration among the first region 221A and the second region 221B.

For example, in the case of FIG. 8, the toner concentration solely in the first region 221A is extremely lowered, and the toner concentration is detected as 5% at a position of the toner concentration detector 224. In contrast, the toner concentration in the second region 221B is almost the same as the target concentration in the axial direction because there is almost no toner consumption. Since the difference between the toner concentration in the first region 221A and the toner concentration in the second region 221B is 1.5%, the difference is the first threshold or above.

Figure 9:
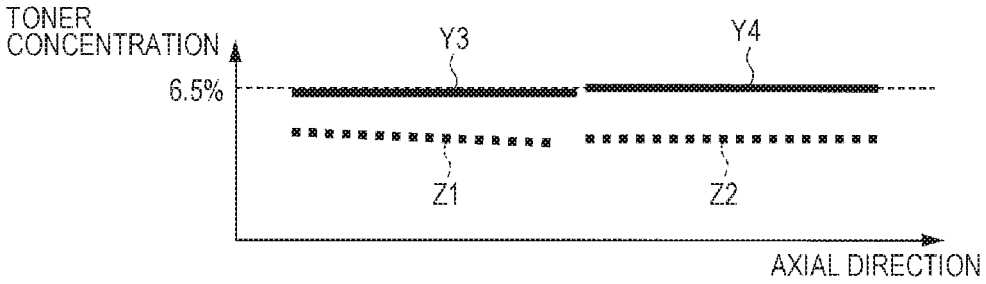
FIG. 9 is a diagram illustrating the toner concentration in the axial direction inside the developer casing.

In this case, the controller 100 shifts the opening/closing part 240 to the closed state and supplies toner to the first region 221A. With this configuration, as illustrated in FIG. 9, it is possible to uniformize the state of the developer in the first region 221A and the second region 221B efficiently and promptly (refer to solid lines Y3 and Y4), and eventually possible to stabilize image quality of the developing apparatus 200 in the whole axial direction.

In contrast, in the case of the configuration in which the first region 221A and the second region 221B are open, the developer in the first region 221A and the developer in the second region 221B are mixed as time elapses, and the decreased toner concentration in the first region 221A would decrease the toner concentration as a whole (refer to broken lines Z1 and Z2). In the present embodiment, however, the first region 221A and the second region 221B are closed, and thus, it is possible to suppress the decrease in the toner concentration as a whole because of either one of the first region 221A and the second region 221B.

Figure 10:
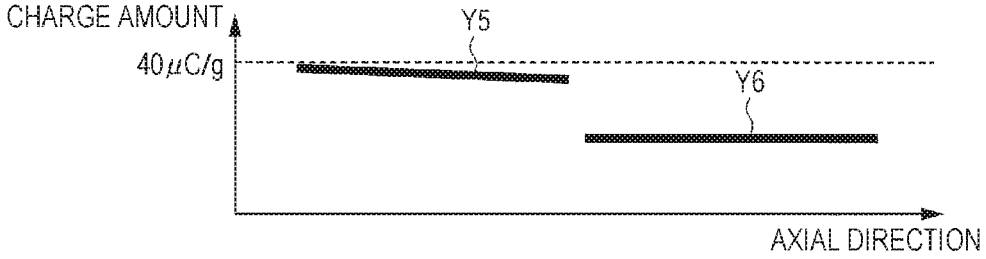
FIG. 10 is a diagram illustrating a toner charge amount in the axial direction inside the developer casing.

Meanwhile, when a toner image as illustrated in FIG. 7 is formed continuously in the closed state of the opening/closing part 240, new toner is supplied to the first region 221A. Accordingly, as illustrated in FIG. 10, the toner charge amount is maintained at a value close to the target charge amount (for example, 40 μC/g) (refer to solid line Y5).

In contrast, there is no toner consumption in the second region 221B, causing an increased amount of toner remaining in the second region 221B without being discharged from the developer casing 220, leading to deterioration of the developer. This causes carrier spent, external additive deterioration, lubricant transition, or the like, in the developer in the second region 221B, leading to a significant decrease in the toner charge amount (refer to solid line Y6).

The difference occurring in the toner charge amount between the first region 221A and the second region 221B causes a density level difference between the first region 221A and the second region 221B in printing, for example, a halftone image, leading to defective image quality. Since a major factor for the decrease in the toner charge amount is deterioration of the carrier, there is a need to uniformize the carrier state in the first region 221A and the second region 221B in order to uniformize the toner charge amount in the first region 221A and the second region 221B.

To cope with this, in the present embodiment, the controller 100 determines whether to switch the opening/closing part 240 from the closed state to the open state in accordance with a difference between the liquid level in the first region 221A and the liquid level in the second region 221B detected by the liquid level detector 226 when the opening/closing part 240 is in the closed state.

Specifically, the controller 100 switches the opening/closing part 240 from the closed state to the open state in a case where the difference between the liquid level in the first region 221A and the liquid level in the second region 221B is larger than a second threshold (for example, 10 mm). This operation opens the first region 221A and the second region 221B and mixes the developer in the whole developer casing 220, leading to achievement of uniformity of the state of the carrier, that is, uniformity of the state of the developer, making it possible to eventually uniformize the toner charge amount. This leads to a less difference of toner charge amount between the first region 221A and the second region 221B, making it possible to efficiently uniformize the state of the developer, and eventually stabilize the image quality.

Moreover, on the basis of the open/closed state of the opening/closing part 240, the controller 100 controls so as to set a rotation speed of the first stirring member 222 and the second stirring member 223 in the first region 221A to a different speed from the rotation speed of the first stirring member 222 and the second stirring member 223 in the second region 221B.

Specifically, the controller 100 controls such that the rotation speed of the first stirring member 222 and the second stirring member 223 becomes higher in a region with a higher liquid level of the developer, that is, a region with a larger toner charge amount, among the first region 221A and the second region 221B, than the rotation speed of the first stirring member 222 and the second stirring member 223 in a region with a lower liquid level of the developer, that is, a region with a smaller toner charge amount.

With this control, it is possible to promptly move the developer in the region with the higher liquid level of the developer to the region with the lower liquid level of the developer, and thus, to promptly uniformize the toner charge amount.

Figure 11:
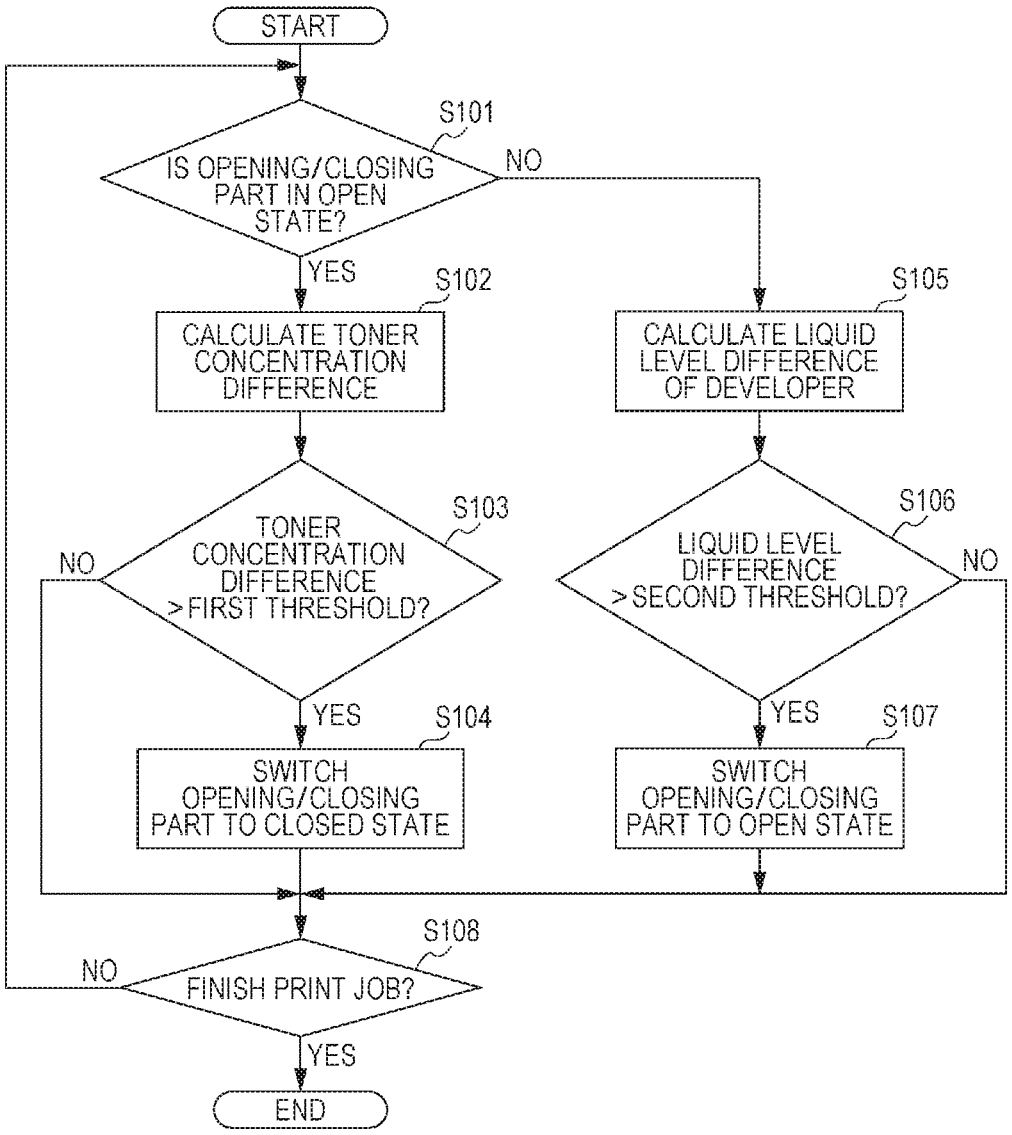
FIG. 11 is a flowchart illustrating exemplary operation of opening/closing control of an opening/closing part in an image forming apparatus.

Next, exemplary operation of opening/closing control of the opening/closing part 240 in the image forming apparatus 1 will be described. FIG. 11 is a flowchart illustrating exemplary operation of opening/closing control of the opening/closing part 240 in the image forming apparatus 1. The processing in FIG. 11 is appropriately executed during a print job.

As illustrated in FIG. 11, the controller 100 determines whether the opening/closing part 240 is in an open state (step S101). In a case where the opening/closing part 240 is in the open state (YES in step S101) as a result of the determination, the controller 100 obtains the toner concentration detected by the toner concentration detector 224 in each of the first region 221A and the second region 221B, and calculates a difference between the toner concentration in the first region 221A and the toner concentration in the second region 221B (step S102).

Next, the controller 100 determines whether the toner concentration difference is larger than a first threshold (step S103). In a case where the toner concentration difference is the first threshold or below (NO in step S103) as a result of the determination, the processing proceeds to step S108. In contrast, in a case where the toner concentration difference is larger than the first threshold (YES in step S103), the controller 100 switches the opening/closing part 240 to a closed state (step S104). After step S104, the processing proceeds to step S108.

Returning to the determination of step S101, in a case where the opening/closing part 240 is not in the open state, that is, in the closed state (NO in step S101), the controller 100 obtains the liquid level detected by the liquid level detector 226 and calculates the difference between the liquid level in the first region 221A and the liquid level in the second region 221B (step S105).

Next, the controller 100 determines whether the liquid level difference is larger than a second threshold (step S106). In a case where the liquid level difference is the second threshold or below (NO in step S106) as a result of the determination, the processing proceeds to step S108. In contrast, in a case where the liquid level difference is larger than the second threshold (YES in step S106), the controller 100 switches the opening/closing part 240 to the open state (step S107). After step S107, the processing proceeds to step S108.

Next, the controller 100 determines whether the print job is finished (step S108). In a case where the print job is not finished (step S108, NO) as a result of the determination, the processing returns to step S101. In a case where the print job is finished (step S108, YES), the control finishes.

According to the present embodiment configured as described above, the open/closed state of the opening/closing part 240 is controlled in accordance with the state of the developer in the first region 221A and the second region 221B. With this configuration, it is possible to efficiently uniformize the state of the developer in the whole axial direction of the developing apparatus 200.

Moreover, the toner supply amount is increased in the region with the larger toner consumption amount when the opening/closing part 240 is switched from the open state to the closed state. Accordingly, it is possible to promptly uniformize the state of the developer in the whole axial direction of the developing apparatus 200.

Moreover, the rotation speed of the stirring member in the region with the larger toner charge amount is set to be higher than the rotation speed of the stirring member in the region with the smaller toner charge amount when the opening/closing part 240 is switched from the closed state to the open state. Accordingly, it is possible to promptly uniformize the state of the developer in the whole axial direction of the developing apparatus 200.

While the above-described embodiment is a case where the opening/closing part 240 is switched from the open state to the closed state in accordance with the toner concentration detected by the toner concentration detector 224, the present invention is not limited thereto. For example, it is allowable to determine the open/closed state of the opening/closing part 240 on the basis of the toner adhesion amount in the toner image on the image carrier such as the photoconductive drum 413 and the intermediate transfer belt 421 to which the toner is supplied by the developing sleeve 210.

In this case, the configuration needs to include a toner amount detector such as a toner concentration detector for detecting the toner adhesion amount on the image carrier. Then, the controller 100 determines whether to switch the opening/closing part 240 from the open state to the closed state in accordance with the difference between the toner amount in the first region 221A and the toner amount in the second region 221B detected by the toner amount detector. It is allowable to set a value corresponding to the first threshold in the toner concentration difference in the above-described embodiment as the threshold related to the toner amount difference.

Moreover, when the opening/closing part 240 is in the open state, the controller 100 may determine whether to switch the opening/closing part 240 from the open state to the closed state in accordance with the difference between the toner image coverage corresponding to the first region 221A and the toner image coverage corresponding to the second region 221B. It is allowable to set a value corresponding to the first threshold related to the toner concentration difference in the above-described embodiment as the threshold related to the toner image coverage difference.

While, the above embodiment is the case where the opening/closing part 240 is switched from the open state to the closed state in accordance with the liquid level of the developer in the developer casing 220, the present invention is not limited thereto. For example, when the opening/closing part 240 is in the closed state, the controller 100 may determine whether to switch the opening/closing part 240 from the closed state to the open state in accordance with an average value of the toner image coverage corresponding to each of the first region 221A and the second region 221B.

The average value of the toner image coverage in either one of the first region 221A and the second region 221B becomes, for example, a third threshold (for example 3%) or below, the external additive of the developer is very likely to be detached or buried, leading to the decrease in the toner charge amount. Accordingly, this control determines to switch the opening/closing part 240 from the closed state to the open state in a case where the average value of the toner image coverage in either one of the first region 221A and the second region 221B becomes the third threshold or below.

Furthermore, any of the above-described embodiments merely illustrates an exemplary embodiment of the present invention, and thus, the technical scope of the present invention should not be limited in interpretation thereof. That is, the present invention can be implemented in various forms without departing from the spirit or the main features thereof.

The present invention is applicable to an image forming system constituted with a plurality of units including an image forming apparatus. The plurality of units includes external apparatuses such as a post-processing apparatus, a network-connected controller.

Finally, an evaluation experiment of the image forming apparatus 1 according to the present embodiment will be described.

First, the effect confirmation was performed on the determination of switching the opening/closing part 240 to the closed state. Specifically, the presence or absence of a level difference in image density and the presence or absence of reduction of density of the initial state were confirmed for a case where image formation of 1,000 sheets of toner images illustrated in FIG. 7 was continuously performed, and thereafter half-tone image formation was performed on the whole surface of the sheet. The opening/closing part 240 is set to the closed state as the present example, and the opening/closing section 240 is set to the open state as a comparative example. Table 1 illustrates an experimental result in the present example and the comparative example.

TABLE 1

| | IMAGE DENSITY LEVEL DIFFERENCE | DENSITY IN INITIAL STATE |
|---|---|---|
| PRESENT EXAMPLE | ○ | ○ |
| COMPARATIVE EXAMPLE | x | x |

In Table 1, "○" indicates that no level difference occurred in the image density, or that no density reduction occurred in the initial state.
Moreover, "x" indicates that a level difference occurred in the image density, or that density reduction occurred in the initial state.

As illustrated in Table 1, it was confirmed that, in the comparative example, a level difference occurred in the halftone image density and density reduction occurred in the whole image from the initial state. In contrast, in the present example, it was confirmed that no level difference occurred in the halftone image density and that no density reduction occurred in the whole image from the initial state, achieving good image quality.

Next, the effect confirmation was performed on the determination of switching the opening/closing part 240 to the open state. Specifically, the presence or absence of the level difference in image density was confirmed for a case where image formation of 100000 sheets of toner images illustrated in FIG. 7 was continuously performed, and thereafter half-tone image formation was performed on the whole surface of the sheet. The opening/closing part 240 is set to the open state as the present example, and the opening/closing section 240 is set to the closed state as a comparative example. Table 2 illustrates an experimental result in the present example and the comparative example.

TABLE 2

| | IMAGE DENSITY LEVEL DIFFERENCE |
|---|---|
| PRESENT EXAMPLE | ○ |
| COMPARATIVE EXAMPLE | x |

"○" in Table 2 indicates that no level difference occurred in the image density.
Moreover, "x" indicates that a level difference occurred in the image density.

As illustrated in Table 2, it was confirmed that a level difference occurred in the halftone image density in the comparative example. In contrast, it was confirmed that no level difference occurred in the halftone image density and good image quality was obtained in the present example.

Finally, the effect confirmation was performed on the determination of changing the rotation speed of the first stirring member 222 and the second stirring member 223 to a different speed between the first region 221A and the second region 221B. Specifically, image formation of 100000 sheets of toner images T illustrated in FIG. 7 was continuously performed with the opening/closing part 240 in the closed state, and thereafter transition of the toner charge amount was confirmed between the case where the rotation speed of the first stirring member 222 and the second stirring member 223 were changed to a different rotation speed, and the case where they were not, with the opening/closing part 240 in the open state.

Note that, in this experiment, the developer in the second region 221B deteriorates because there is no consumption of the developer in the second region 221B in the toner image T illustrated in FIG. 7, and thus, the rotation speed of the first stirring member 222 and the second stirring member 223 is changed to the different speed in the first region 221A.

The rotation speed of the first stirring member 222 and the second stirring member 223 is set to 450 rpm. In a case where the rotation speed of the first stirring member 222 and the second stirring member 223 in the first region 221A is changed to a different rotation speed, the rotation speed is set to 500 rpm.

Figure 12:
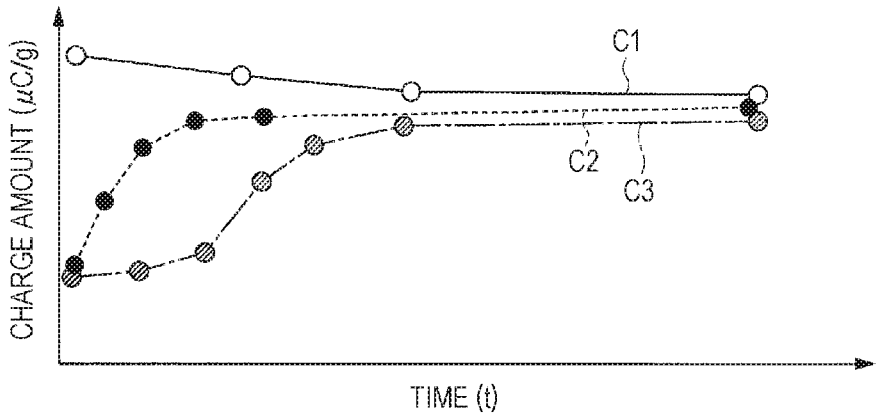
FIG. 12 is a diagram illustrating a time course of the toner charge amount.

FIG. 12 is a diagram illustrating a time course of the toner charge amount. Solid line C1 in FIG. 12 indicates the charge amount of the first region 221A, that is, the toner on the side where the developer has not deteriorated. Broken line C2 indicates the toner charge amount in the second region 221B, that is, the toner change amount on the side where the developer has deteriorated, indicating the case where the rotation speed of the first stirring member 222 and the second stirring member 223 in the first region 221A is changed to a different rotation speed. One-dot chain line C3 indicates the toner charge amount in the second region 221B, indicating the case where the rotation speed of the first stirring member 222 and the second stirring member 223 in the first region 221A is not changed to a different speed.

As illustrated in FIG. 12, there is no difference in the toner charge amount in the first region 221A between the case where the rotation speed of the first stirring member 222 and the second stirring member 223 in the first region 221A is changed to a different speed and the case where the speed is not changed (refer to solid line C1).

In contrast, it can be confirmed that the toner charge amount in the second region 221B in a case (broken line C2) where the rotation speed of the first stirring member 222 and the second stirring member 223 in the first region 221A is changed to a different speed reaches a point closer to the toner charge amount indicated by solid line C1 sooner than the case (one-dot chain line C3) where the rotation speed in the first region 221A is not changed. Consequently, it was confirmed that the concentration of the toner can be promptly uniformized by changing the rotation speed of the first stirring member 222 and the second stirring member 223 in the first region 221A to a different speed.

Although embodiments of the present invention have been described and illustrated in detail, it is clearly understood that the same is by way of illustration and example only and not limitation, the scope of the present invention should be interpreted by terms of the appended claims.

What is claimed is:

1. A developing apparatus comprising:

a developer carrier that carries a developer;

a developer casing that contains the developer to be supplied to the developer carrier;

an opening/closing part capable of controlling a moving amount of the developer between a first region on one side in an axial direction of the developer carrier and a second region on the other side in the axial direction of the developer carrier by opening or closing the first region and the second region; and a hardware processor that controls an open/closed state of the opening/closing part in accordance with the state of the developer in the first region and the second region.

2. The developing apparatus according to claim 1, further comprising a toner concentration detector that detects a toner concentration in the developer casing, wherein, when the opening/closing part is in an open state, the hardware processor determines whether to switch the opening/closing part from the open state to the closed state in accordance with a difference between the toner concentration in the first region and the toner concentration in the second region, detected by the toner concentration detector.

3. The developing apparatus according to claim 2, further comprising a toner supplier that supplies toner to the developer casing, wherein, in a case where the opening/closing part is switched from the open state to the closed state, the hardware processor controls the toner supplier so as to increase a toner supply amount in a region having a larger toner consumption amount among the first region and the second region.

4. The developing apparatus according to claim 1, further comprising a toner amount detector that detects a toner amount in a toner image on an image carrier to which toner has been supplied from the developer carrier, wherein, when the opening/closing part is in an open state, the hardware processor determines whether to switch the opening/closing part from the open state to the closed state in accordance with a difference between the toner amount at a position corresponding to the first region and the toner amount at a position corresponding to the second region, detected by the toner amount detector.

5. The developing apparatus according to claim 1, further comprising a liquid level detector that detects a liquid level of the developer in the developer casing, wherein, when the opening/closing part is in a closed state, the hardware processor determines whether to switch the opening/closing part from the closed state to the open state in accordance with a difference between the liquid level in the first region and the liquid level in the second region, detected by the liquid level detector.

6. The developing apparatus according to claim 5, further comprising:

a first stirrer that stirs the developer in the first region; and a second stirrer that stirs the developer in the second region, wherein, when the opening/closing part is switched from the closed state to the open state, the hardware processor sets a rotation speed of the stirrer in the region with a larger toner charge amount among the first region and the second region to a higher rotation speed than the rotation speed of the stirrer in the region with a smaller toner charge amount.

7. An image forming apparatus comprising:

a developer carrier that carries a developer;

a developer casing that contains the developer to be supplied to the developer carrier;

an opening/closing part capable of controlling a moving amount of the developer between a first region on one side in an axial direction of the developer carrier and a second region on the other side in the axial direction of the developer carrier by opening or closing the first region and the second region; and a hardware processor that controls an open/closed state of the opening/closing part in accordance with the state of the developer in the first region and the second region.

8. The image forming apparatus according to claim 7, further comprising a toner concentration detector that detects a toner concentration in the developer casing, wherein, when the opening/closing part is in an open state, the hardware processor determines whether to switch the opening/closing part from the open state to the closed state in accordance with a difference between the toner concentration in the first region and the toner concentration in the second region, detected by the toner concentration detector.

9. The image forming apparatus according to claim 8, further comprising a toner supplier that supplies toner to the developer casing, wherein, in a case where the opening/closing part is switched from the open state to the closed state, the hardware processor controls the toner supplier so as to increase a toner supply amount in a region having a larger toner consumption amount among the first region and the second region.

10. The image forming apparatus according to claim 7, further comprising a toner amount detector that detects a toner amount in a toner image on an image carrier to which toner has been supplied from the developer carrier, wherein, when the opening/closing part is in an open state, the hardware processor determines whether to switch the opening/closing part from the open state to the closed state in accordance with a difference between the toner amount at a position corresponding to the first region and the toner amount at a position corresponding to the second region, detected by the toner amount detector.

11. The image forming apparatus according to claim 7, further comprising a liquid level detector that detects a liquid level of the developer in the developer casing, wherein, when the opening/closing part is in a closed state, the hardware processor determines whether to switch the opening/closing part from the closed state to the open state in accordance with a difference between the liquid level in the first region and the liquid level in the second region, detected by the liquid level detector.

12. The image forming apparatus according to claim 11, further comprising:

a first stirrer that stirs the developer in the first region; and a second stirrer that stirs the developer in the second region, wherein, when the opening/closing part is switched from the closed state to the open state, the hardware processor sets a rotation speed of the stirrer in the region with a larger toner charge amount among the first region and the second region to a higher rotation speed than the rotation speed of the stirrer in the region with a smaller toner charge amount.

* * * * *